US007154442B2

(12) United States Patent
van Wonterghem et al.

(10) Patent No.: US 7,154,442 B2
(45) Date of Patent: Dec. 26, 2006

(54) BUILT-IN WHIP ANTENNA FOR A PORTABLE RADIO DEVICE

(75) Inventors: Jari van Wonterghem, Vancouver (CA); Ping Hui, Richmond (CA)

(73) Assignee: Nokia Corporation, Espoo (FI)

( * ) Notice: Subject to any disclaimer, the term of this patent is extended or adjusted under 35 U.S.C. 154(b) by 105 days.

(21) Appl. No.: 10/878,302

(22) Filed: Jun. 28, 2004

(65) Prior Publication Data

US 2005/0285798 A1 Dec. 29, 2005

(51) Int. Cl.
*H01Q 1/24* (2006.01)

(52) U.S. Cl. ..... 343/702; 343/790

(58) Field of Classification Search ..... 343/702, 343/901, 903, 790, 791, 792
See application file for complete search history.

(56) References Cited

U.S. PATENT DOCUMENTS 5,089,829 A * 2/1992 Haruyama et al. ..... 343/852
5,307,078 A * 4/1994 Tanaka et al. ..... 343/791
5,606,332 A * 2/1997 Darden et al. ..... 343/790
6,466,173 B1 10/2002 Li ..... 343/702
6,486,835 B1 11/2002 Wakeham ..... 343/702
6,611,691 B1 * 8/2003 Zhou et al. ..... 343/709
2004/0113849 A1 * 6/2004 Jarmuszewski et al. ..... 343/702
2005/0243000 A1 * 11/2005 Hwang et al. ..... 343/702

* cited by examiner

*Primary Examiner*—Trinh Dinh
*Assistant Examiner*—Huedung Mancuso
(74) *Attorney, Agent, or Firm*—Harrington & Smith, LLP

(57) ABSTRACT

An antenna assembly for a portable radio device/mobile station is provided. The assembly includes a retractable whip antenna 24, a first radio lead 50 for coupling the whip antenna to a mobile telephony receiver, and a second radio lead 48 for coupling the whip antenna 24 to a FM or DVB receiver. Each lead is coupled to the whip antenna at least when the whip antenna is fully extended. In one embodiment, received signals are frequency discriminated by a RF choke such as an inductor 52 along the second radio lead. In another embodiment, the first radio lead is coupled directly to a PIFA antenna 58 internal to the portable device, and the whip antenna is in parasitic communication 64 with the PIFA antenna at least when the whip antenna is extended and receiving signals above a threshold frequency. In that alternative embodiment, the whip antenna is preferably decoupled from ground.

20 Claims, 5 Drawing Sheets

BUILT-IN WHIP ANTENNA FOR A PORTABLE RADIO DEVICE

FIELD OF THE INVENTION

The present invention generally relates to receiving broadcast radio signals, such as AM or FM at a portable radio transceiver such as a mobile station that receives communications over different channels. The invention particularly relates to a whip antenna adapted such that a portable device may receive broadcast radio signals over the whip antenna and two-way communications such as using a CDMA protocol over either the same whip antenna or a separate planar antenna.

BACKGROUND

A strong trend in consumer electronics is to consolidate disparate functions into a single device to minimize the frequency with which users need to carry multiple portable electronic devices. While different demographic segments desire different combinations of functions, an appreciable number of consumers have adopted mobile stations that have the capability to receive broadcast radio such as AM and FM in addition to their more traditional two-way communication functions, which were once predominantly voice communications but are increasingly voice and/or data. However, broadcast radio signals and two-way communications use fundamentally different transmission protocols, and mobile stations having a FM reception capability typically included separate antennas for the distinct communication types.

When an antenna is in resonance at a resonance frequency, there will be an electromagnetic (EM) wave excited corresponding to the resonance frequency. The operating length of the antenna is designed based on the wavelength $\lambda$ of the intended resonance frequency, generally $\lambda/n$ of a wavelength where n is an even integer. To avoid antenna breakage and enhance signal reception, the planar inverted-F antenna (PIFA) antenna has been recently developed that decreases operating length of an antenna structure to $\lambda/4$ in a PIFA, as compared to $\lambda/2$ typically used for whip antennas. For an example of a PIFA antenna, see co-assigned U.S. Pat. No. 6,646,610. Also, the PIFA can be placed above a ground plane and embedded within a durable housing of the mobile station, protecting the PIFA from damage and obscuring it from view. Most mobile stations operate in accordance with GSM 900 and/or GSM 1800, so their resonance frequency is 900 MHz or 1800 MHz. By contrast, in the United States the frequency band for broadcast FM radio is between 88 and 108 MHz. As wavelength is inversely proportional to frequency, reception of FM signals requires a longer antenna than reception of GSM signals.

To enable the same mobile station to receive broadcast FM radio signals as well as engage in traditional two-way (voice or data) communications, two antennas were generally used. The two-way communications antenna may have been a whip antenna or a PIFA, whereas the broadcast FM reception antenna was embodied in a wire leading to an earpiece or headset. Given the popularity of wireless headsets for listening to a mobile station's traditional two-way communications, it is envisioned that consumers would also support a wireless headset that will additionally receive broadcast FM signals, at least when they are not actively engaged in a telephone conversation or other two-way communication of data over traditional mobile phone links. Listening to broadcast radio through a mobile device's built-in speaker without the need for a headset as antenna is also desirable. As the wire of prior art headsets acted as the FM reception antenna, the anticipated consumer need is not readily evident. While there have been attempts at integrating an FM antenna internal to a mobile station, their reception quality has generally been poor.

One prior art innovation to effect the above result is disclosed in co-owned U.S. Pat. No. 6,466,173, herein incorporated by reference in its entirety, which describes a whip antenna transducer and a patch or PIFA antenna that is internal to the device, each connected to radio circuitry via a switch that is actuated based on the position of the whip antenna, extended or retracted. As such, only one antenna is coupled to receiving circuitry at any time. Another co-owned prior art invention, U.S. Pat. No. 6,486,835 B1, discloses detecting a position of a retractable antenna relative to a fixed antenna, and is incorporated by reference in its entirety as relevant to a switch actuated based on a position of a retractable antenna.

What is needed in the art is a mobile station or other portable electronic device that is enabled to receive both two-way communications and broadcast radio signals, at least broadcast FM radio signals, each with low loss characteristics and without the need for a conductor extending many times the length of the mobile station housing.

SUMMARY OF THE INVENTION

This invention is in one aspect an antenna assembly for a portable electronic device such as a mobile station. The portable electronic device includes a housing. The antenna assembly has an antenna and first and second radio leads. The antenna has an elongated shaft that is slideable between extended and retracted positions through an aperture defined by the housing of the portable device. The first radio lead is electrically coupled to the antenna, and is for coupling the antenna to a mobile telephony receiver at least when the antenna is in the extended position. The second radio lead is also electrically coupled to the antenna, but is for coupling the antenna to a broadcast radio receiver at least when the antenna is in the extended position. The mobile telephony receiver and the broadcast radio receiver are disposed within the housing but do not form part of the antenna assembly. In one embodiment, the second radio lead has a RF choke such as an inductor that separates received signals in the frequency domain. In an alternative embodiment, the first radio lead is coupled to the whip antenna via capacitive coupling and a fixed antenna internal to the housing. In that alternative embodiment, preferably the whip antenna is decoupled from a common potential to prevent undesirable capacitive parasitic coupling. Various implementations are detailed below.

The present invention is in another aspect an improvement on a mobile station that has a transceiver for communicating over a two-way communication system and a receiver for receiving broadcast radio signals, each within a housing of the mobile station. The improvement includes a whip antenna coupled to a first and second radio lead. The whip antenna has an elongated shaft that is moveable between an extended position that protrudes beyond the housing and a retracted position. The first radio lead is for electrically coupling the transceiver to the whip antenna. The second radio lead is coupled at one end to the receiver and at an opposed end to the whip antenna, at least when the whip antenna is in the extended position. Preferred and alternative embodiments as in the above paragraph are also within this aspect of the invention.

In yet another aspect, the present invention is a method for receiving a signal at a mobile station. The method includes providing a mobile station having a retractable whip antenna, extending the whip antenna to a fully extended position, and receiving a signal at the fully extended whip antenna. Particularly novel is that, in the case that the signal is above a threshold frequency, the method provides the received signal to a mobile telephony receiver via a first radio lead, and in the case that the signal is below a threshold frequency, the method provides the received signal to a broadcast radio receiver via a second radio lead. Specific embodiments on how to affect that frequency-selective providing to the different receivers is detailed below.

These and other features, aspects, and advantages of embodiments of the present invention will become apparent with reference to the following description in conjunction with the accompanying drawings. It is to be understood, however, that the drawings are designed solely for the purposes of illustration and not as a definition of the limits of the invention.

DETAILED DESCRIPTION

Figure 1:
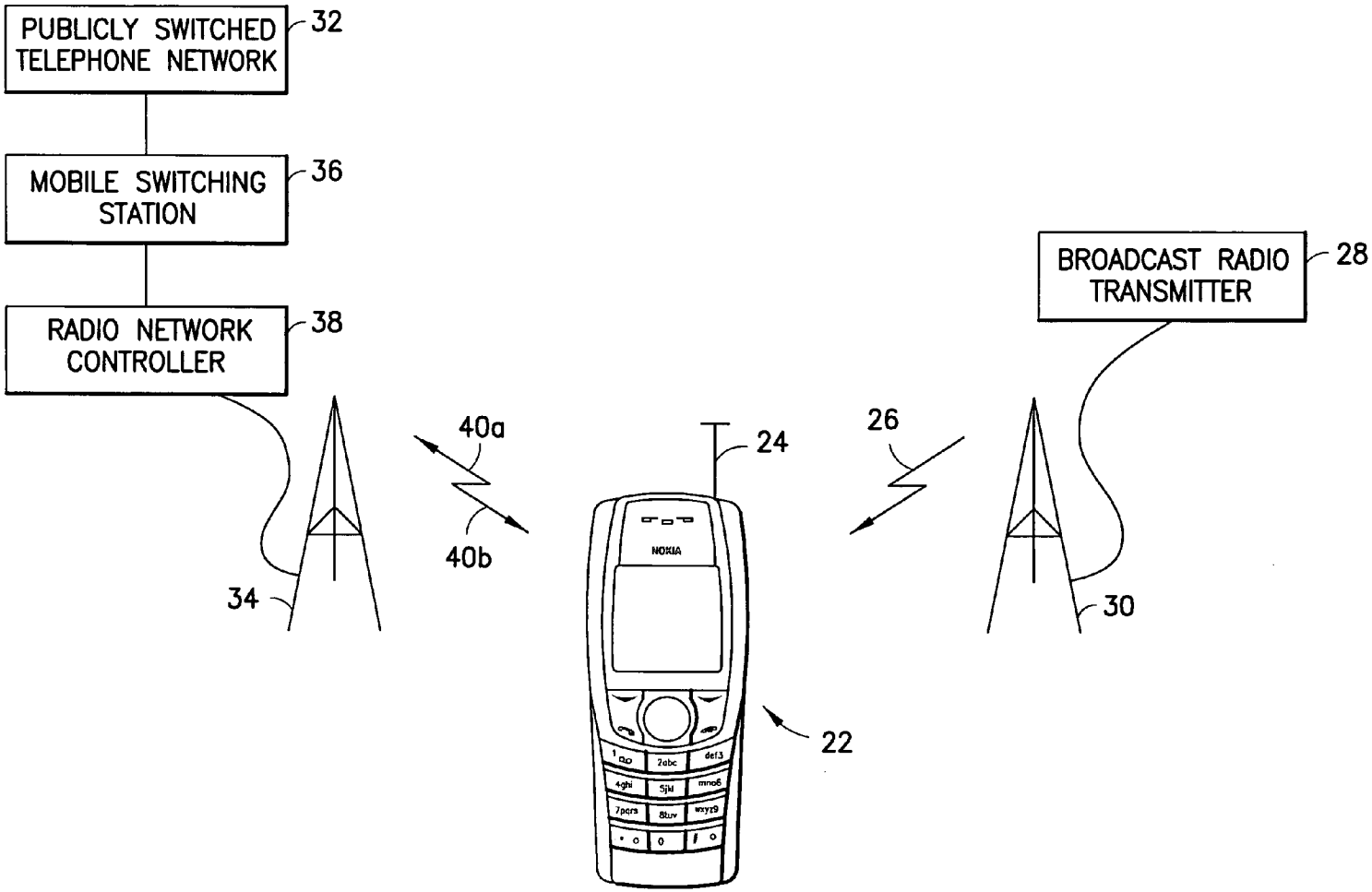
FIG. 1 is a schematic diagram showing a portable radio device for receiving communications from a two-way communication system and from a broadcast radio system via a whip antenna according to the present invention.

FIG. 1 is a schematic diagram of a portable electronic device such as a mobile station 22 having a retractable whip antenna 24 in an environment where it may receive disparate radio signals from different communication systems. One such type of signals is broadcast radio signals such as FM radio signals 26 broadcast by a broadcast radio transmitter 28 through a FM broadcast antenna 30. However, the broadcast radio signal need not be within the FM band; the present invention is adaptable to receive any frequency within the HF or UHF bands by using matching components to tune the whip antenna to the desired broadcast radio frequency. The present invention can be used for FM radio reception, digital video broadcast (DVB) reception, or any broadcast radio frequency up to about 1 GHz. For reasons detailed below, the broadcast radio signals are preferably less than about several hundred MHz. The other type of signal is the downlink of a two-way communication system such as a mobile telephony network, wherein a call is routed from a publicly-switched telephone network 32 to a cellular broadcast tower 34 or base station through a mobile switching center 36 and a radio network controller 38.

The two-way communication system has both an uplink 40*a* (from the mobile station) and a downlink 40*b* (to the mobile station) between the mobile station 22 and the base station 34, whereas the broadcast radio has only a downlink 26. The two-way communication system encompasses a plurality of mobile stations and base stations, as well as several radio network controllers that each controls several base stations. Users operating an individual mobile station do so on a subscriber basis, and each mobile station is uniquely identified to the two-way communications network via an identification number that it transmits to the base station upon call setup or initial power-on. In contrast, receivers in general, and the FM receiving mobile station of FIG. 1, are not identified to the FM broadcaster, and need not be subscribers (though a subscriber basis for satellite based broadcast radio is noted). One important difference is that the mobile station receives and transmits on the two-way communication system, yet only receives signals on the broadcast radio system. This distinction holds true with digital video broadcasts (DVB), which is becoming available for portable devices with the DVB-H standard (DVB for handhelds, derived from the more generic terrestrial DVB-T). Interactivity with a broadcaster of a DVB-H signal is generally embodied in the downlink to the mobile station being over a DVB-H network and the uplink from the mobile station to the broadcaster (or intermediary) over a separate communication system, such as a cellular telephone network. As such, DVB generally and DVB-H specifically remain downlink-only systems. The following description refers to broadcast FM radio signals as an exemplary embodiment and not a limitation to the invention.

In a preferred embodiment, the mobile station 22 receives both mobile telephony signals and broadcast radio signals via the whip antenna 24. In an alternative embodiment, the mobile station receives broadcast radio signals via the whip antenna 24 and mobile telephony signals over a separate antenna such as a PIFA internal to a durable mobile station housing. It is noted that the mobile station will be described as receiving via the antenna 24 signals over the two-way communication network, but it is understood that transmissions on the uplink 40*a* from the mobile station 22 are also via that same antenna 24. Those embodiments are detailed further herein.

Figure 2B:
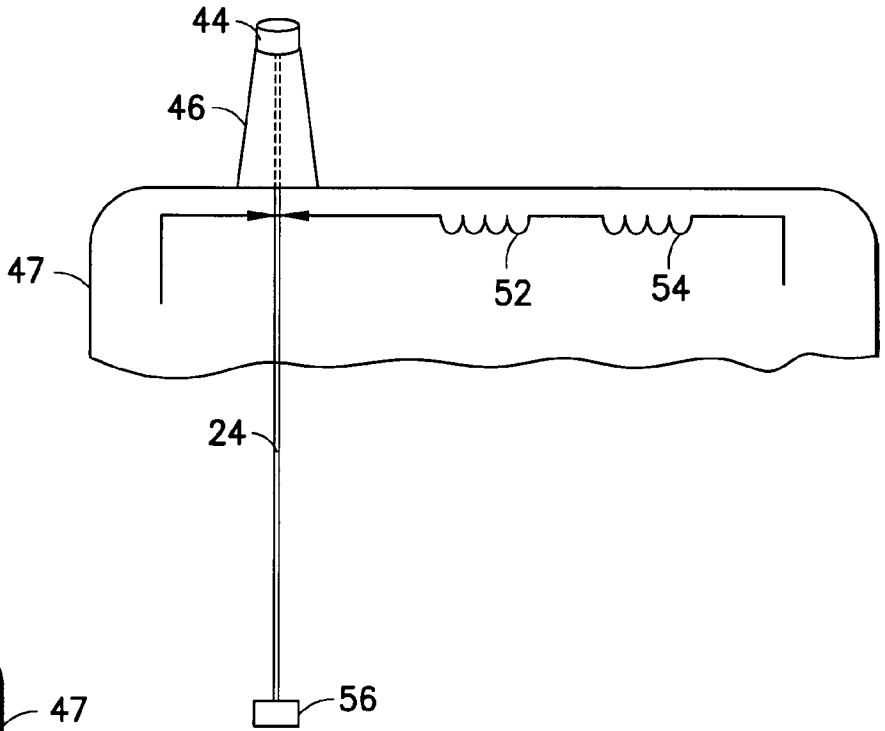
FIG. 2B is similar to FIG. 2A, but showing the whip antenna in a fully retracted position.
Figure 2A:
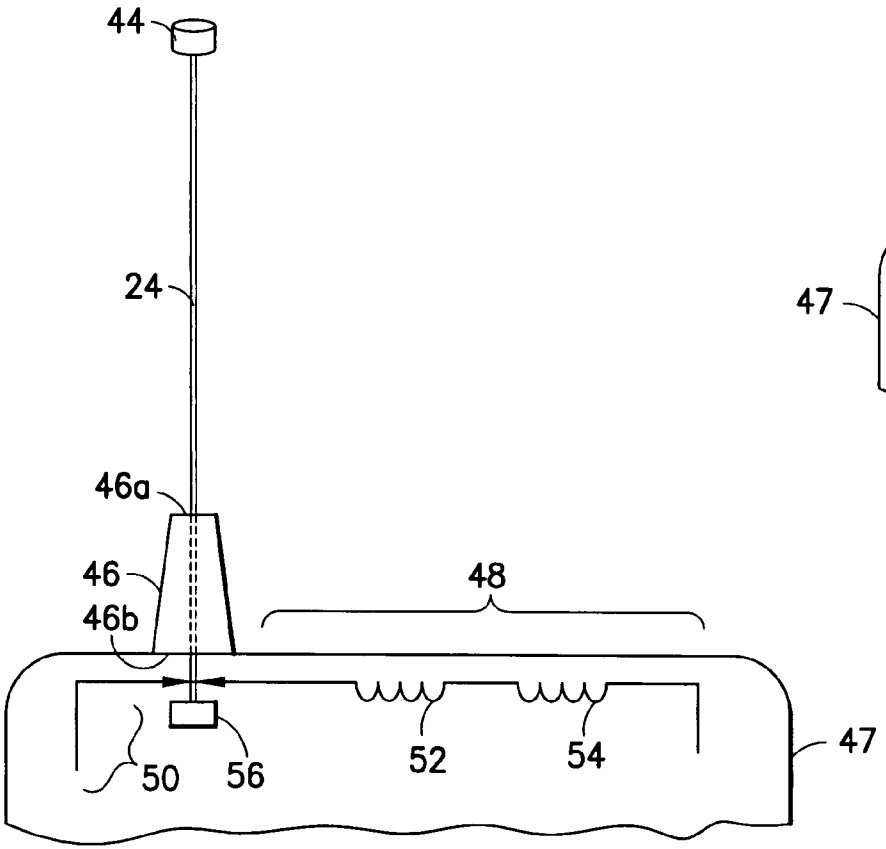
FIG. 2A is a schematic diagram showing the antenna assembly of the preferred embodiment with the whip antenna in a fully extended position.

An antenna assembly 42 according to the preferred embodiment of the present invention is detailed in schematic form at FIGS. 2A and 2B. At FIG. 2A, a whip antenna 24 having an elongated shaft and a terminal cap 44 is depicted as extending through a stub antenna 46 such that a non-negligible length is defined between the cap 44 and an upper surface 46*a* of the stub antenna 46. A lower surface 46*b* of the stub antenna 46 faces and is preferably in contact with an exterior surface of a mobile station housing 47. Preferably, the whip antenna 24 defines a length of about 12 cm when fully extended, which is about the maximum length that may be stored within the housing 47 of a standard mobile station when retracted, absent bending or telescoping of the whip antenna 24. Most preferably, the whip antenna 24 defines a length between about 9 cm and about 12 cm and is made from a conductive plastic material.

The whip antenna 24 is slideable between an extended position (FIG. 2A) and a retracted position (FIG. 2B) through an aperture defined by the stub antenna as is known in the art. In either the extended or retracted position, the whip antenna 24 is coupled to a FM radio feed 48 that electrically couples a FM radio receiver to the whip antenna 24. A mobile telephony radio feed 50 electrically couples a mobile telephony receiver to the whip antenna 24, and through the whip antenna 24 to the stub antenna 46.

Generally, a portable radio device according to the present invention will include a mobile telephony transceiver (not shown) coupled through a transmit/receive switch to the mobile telephony radio feed 50. The mobile telephony transceiver may have a RAKE receiver as known in the art for receiving, demodulating and decoding signals on the downlink 40*b* of the two-way communication system. The portable radio device generally also includes a broadcast radio receiver coupled to the broadcast radio feed 48 for receiving signals over the downlink 26 of the broadcast radio system. Preferably, such a broadcast radio receiver is to receive frequency modulated signals and is a super heterodyne receiver having a limiter and a Foster-Seeley discriminator for detecting and demodulating a FM signal. The RAKE and super heterodyne receiver may share components as fabricated on a circuit board, but are functionally different receivers.

The FM radio feed 48 includes a radiofrequency (RF) choke such as a decoupling inductor 52. Also within the FM radio feed 48 is a matching inductor 54 in series with the RF choke. The RF choke is used as a signal blocking element, and apart from a small inductor, may also be embodied as a transistor such as a field effect transistor (FET), preferably with ferrite beads on leads thereof to minimize parasitic oscillations within nearby circuitry. The RF choke (e.g., the decoupling inductor 52) isolates the FM radio signal 26 from the downlink mobile telephony signal by frequency. Where the downlink signals 40*a* of the two-way communication system are above about 800 MHz, a decoupling inductor 52 exhibiting an inductance of about 50nH and greater effectively prevents the received mobile telephony signal 40*a* from passing while incurring little loss to the FM radio signal of about 88–108 MHz. The matching inductor 54 matches with the whip antenna 24 for the desired frequencies to be received, and in the above example for FM radio would exhibit an inductance of about 470 to 810 nH. While the antenna assembly is described specifically with reference to reception of broadcast FM signals, it may be adapted to receive broadcasts in the HF or UHF bands by changing the matching inductor 54 (and other matching components in the receiver) to tune the whip antenna 24 to the desired frequency.

While the whip antenna 24 is in the extended position of FIG. 2A, the receiver for mobile telephony downlink signals receives through the whip antenna 24. While the whip antenna 24 is in the retracted position of FIG. 2B, the receiver for mobile telephony receives downlink signals through the stub antenna 46 that is coupled to the mobile telephony radio feed 50 through the whip antenna. Alternatively, the mobile telephony radio feed 50 may be coupled in parallel to each of the whip 24 and stub 46 antennas, and process the stronger signal at the RAKE or other mobile telephony receiver. It is noted that the whip antenna 24 remains coupled to the mobile telephony radio feed whether extended or retracted.

While in the retracted position, the whip antenna 24 would generally exhibit high loss for FM radio reception due to proximity to other electronic components and shielding due to those components and to the housing 47 of the mobile station 22. Consequently, an optional feature is a means to disable the connection between the FM radio receiver and the whip antenna 24 when the whip antenna 24 is retracted. This may be embodied in a switch that is opened, for example, by the bottom 56 of the whip antenna 24 when the whip antenna is in the fully retracted position (e.g., the cap 44 in contact with the upper surface 46*a* of the stub antenna 46, a spring clip that engages the FM radio lead 48 only when the whip antenna 24 is fully extended, a detector that senses (mechanically, optically) when the bottom 56 of the whip antenna is in a position corresponding to the fully retracted position, etc. The bottom 56 is that end of the whip antenna 24 opposed to the cap 44.

Figures 3A, 3B:
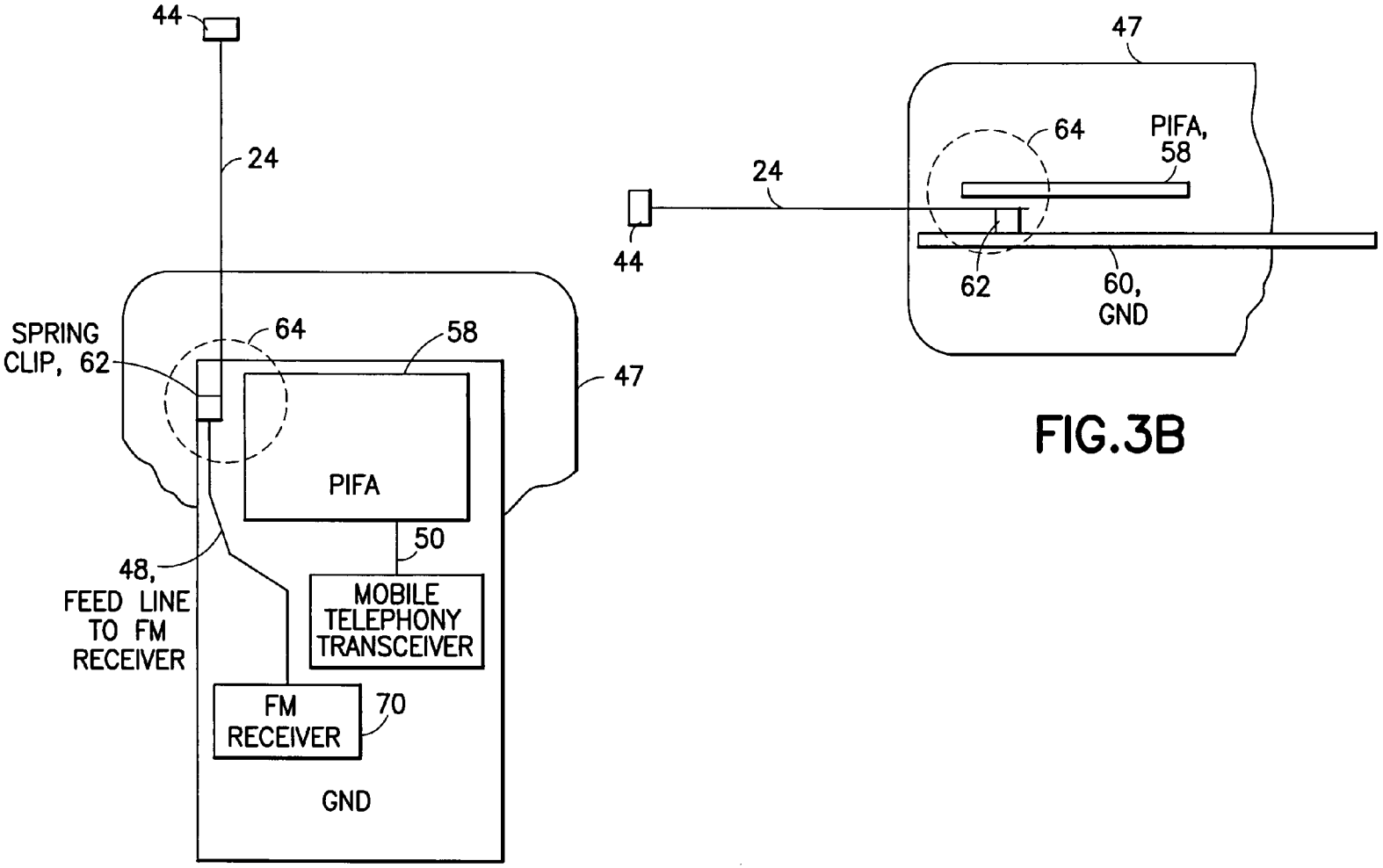
FIG. 3A is a schematic plan view diagram showing an alternative embodiment of the present invention wherein the whip antenna is in parasitic communication with an antenna fixed within the portable device, at least under certain conditions described herein.
FIG. 3B is similar to FIG. 3B but showing a side view of the spring clip connection.

An alternative embodiment of the present invention uses a retractable whip antenna 24 and a separate internal antenna within the mobile station housing, preferably a planar antenna such as a PIFA. This alternative embodiment is detailed in the schematic diagram of FIG. 3A (plan view) and FIG. 3B (side view). A mobile station defines a housing 47 that encloses a fixed internal antenna 58, preferably a planar antenna such as a PIFA optimized for transceiving mobile telephony network signals 40*a*, 40*b*. The planar antenna 58 is coupled to receiving and transmitting circuitry via a mobile telephony radio feed 50, and to a common potential 60. A separate retractable whip antenna 24 is removably coupled to an FM radio feed 48 when the whip antenna is fully extended. As shown, a conductive deformable clip, or spring clip 62, couples the FM radio lead 48 and the whip antenna 24 so that direct electrical contact is broken at least when the whip antenna 24 is fully retracted, and preferably whenever the whip antenna is in the fully extended position or nearly fully extended. Typically in mobile stations with retractable antennas, the spring clip 62 is embodied as a closed cylindrical-type body defining an axial passageway through which the whip antenna 24 passes. In such an embodiment, it is common for a block or bottom 56 (FIGS. 2A–2B) at the end of the whip antenna 24 opposite the cap 44 makes contact with an interior-facing surface of the cylindrical-type spring clip to affect the contact when the whip antenna is in the fully extended position.

The internal antenna 58 and the whip antenna 24 are in close proximity to one another but not in direct physical contact. The proximal distance between them is such that they undergo parasitic coupling in the area indicated by the dotted circle 64, at least when the mobile station 22 receives and transmits on frequencies appropriate to the two-way communications system (e.g., greater than about 900 MHz) and the whip antenna 24 is extended. Preferably, the elongated shaft 24 of the whip antenna and the internal antenna are within approximately 5 mm of one another to facilitate strong parasitic coupling. In parasitic coupling, one antenna reflects or re-radiates energy from a second antenna and thereby maintains a phase relationship with the second antenna. In the particular instance of FIG. 3A, transmissions are directed to the internal antenna 58 via the mobile telephony radio feed, radiation is sensed at the whip antenna 24 via parasitic coupling at the area 64, and the whip antenna re-radiates the transmission on the uplink 40*a*. When receiving on the downlink 40*b*, the signal is received at the whip antenna 24 and at the internal antenna 58. Should the stronger signal be at the whip antenna 24, the parasitic connection 64 ensures the additional signal strength is not lost but re-radiated to the internal antenna 58, where it directly couples to receiving circuitry via the mobile telephony radio feed 50.

While receiving and transmitting at mobile telephony frequencies, it is an important aspect of the alternative embodiment of the invention that the whip antenna 24 be disconnected from a common potential 60 or ground. This is to enable the whip antenna to enter and maintain phase relation with the internal antenna 58, and properly re-radiate energy sensed at the parasitic coupling area 64. Typical within mobile stations and other portable radio devices, RF circuits are constructed in shielded enclosures, often with internal grounded partitions between sections of the circuitry to prevent coupling. It is common to build such RF circuitry on two-sided PC board, with one side used as a ground plane. Alternatively, a circuit may be constructed immediately adjacent to a shield or other grounded surface.

Figure 4:
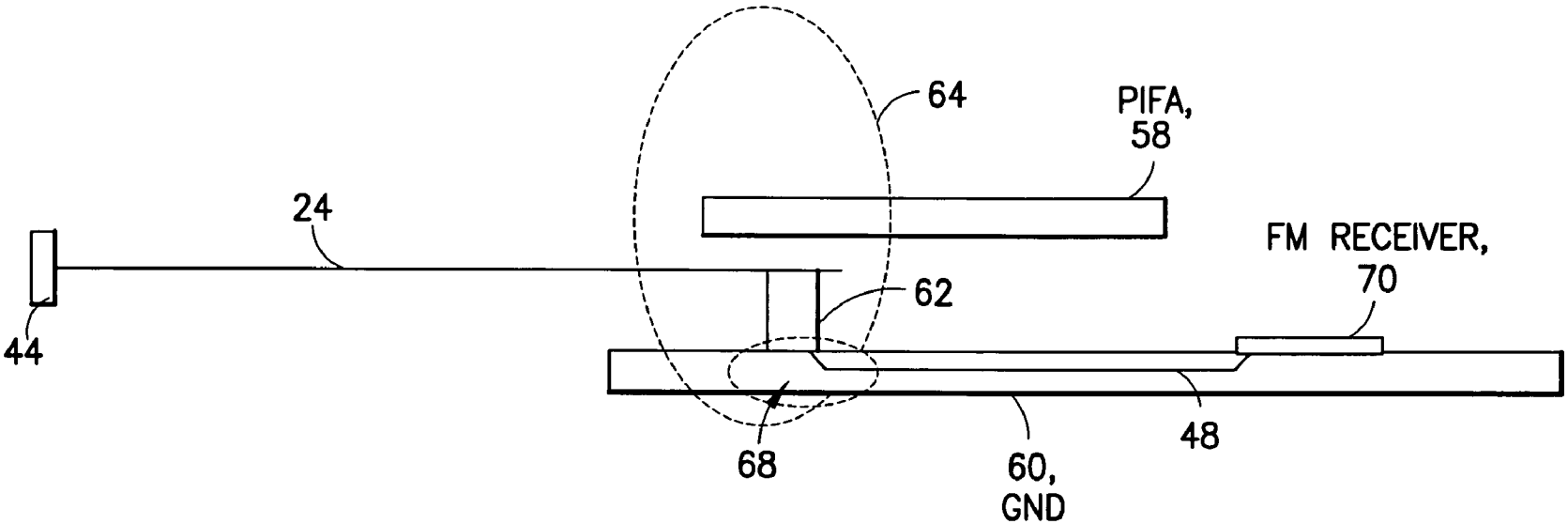
FIG. 4 is similar to FIG. 3B but showing the FM receiver with related feed line and an area of undesirable parasitic coupling.

FIG. 4 shows a side view of the alternative embodiment wherein the area of undesirable parasitic coupling 68 is indicated by a broken line. The desirable parasitic coupling 64 between the antennas is influenced by parasitic loading 64 in the area of the spring clip 62, due to the spring clip's proximity to the ground plane 60 of the circuit board. This is not particularly detrimental when receiving FM signals at the FM receiver 70, but may cause some interference with the desirable parasitic coupling when using the two-way communication system (which employs the PIFA 58).

Figure 5:
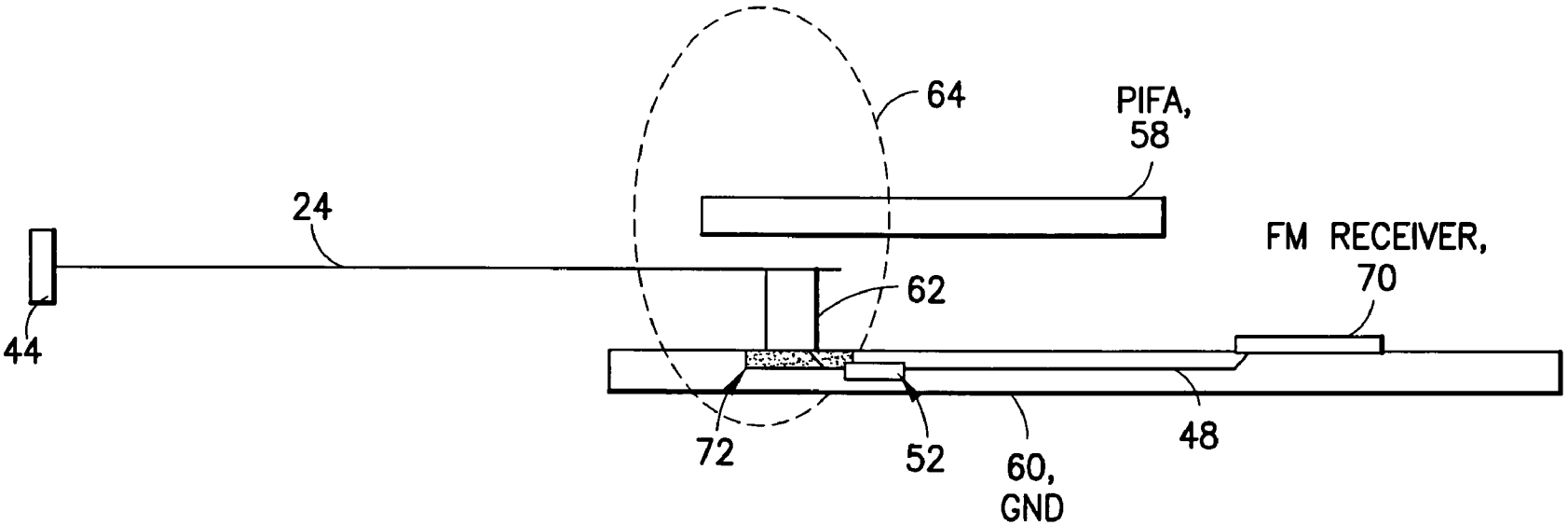
FIG. 5 is similar to FIG. 4 but showing ground layers removed from the area of the spring clip to reduce or eliminate the undesirable parasitic coupling.

FIG. 5 illustrates a remedy to the undesirable parasitic loading. An electrically insulating barrier 72 is disposed between the spring clip 62 and the ground plane 60. This insulating barrier is preferable formed in the circuit board (assuming the ground plane is one side of the circuit board as described above), and may be a specific insulating material or a lack of electrical contacts to a common potential/ground 60. A cost effective implementation is to use a segment of silicon dioxide, or other semiconducting material from which the circuit board is made, as the insulating barrier by not imposing leads to ground in that segment. Another solution is to dispose an insulating layer in the area of the circuit board that is to be adjacent to the spring clip 62, with only the FM radio feed 48 passing through for connection to the spring clip 62. A decoupling inductor 52 is disposed along the FM radio lead 48, preferably as near as possible to the spring clip 62 to decouple signals received from the two-way communication system from the FM radio lead 48.

It is noted that for most common inductors that may be used within the present invention as detailed above, parasitic capacitance will effectively limit broadcast radio reception to frequency bands only up to about several hundred MHz. This is seen as a limitation inherent in commonly available components rather than a limitation to the broader aspects of the invention, as it may be overcome by advances in inductor technology.

While there has been illustrated and described what is at present considered to be preferred and alternative embodiments of the claimed invention, it will be appreciated that numerous changes and modifications are likely to occur to those skilled in the art. It is intended in the appended claims to cover all those changes and modifications that fall within the spirit and scope of the claimed invention.

What is claimed:

1. An antenna assembly for a portable electronic device, the antenna assembly comprising:

an antenna having an elongated shaft that is slideable between an extended and a retracted position through an aperture defined by a housing of a portable electronic device;

a first radio lead electrically coupled to the antenna for coupling the antenna to a mobile telephony receiver at least when said antenna is in the extended position; and a second radio lead electrically coupled to the antenna for coupling the antenna to a broadcast radio receiver at least when said antenna is in the extended position, wherein the second radio lead comprises a RE choke that blocks frequencies in a mobile telephony band and passes frequencies in a broadcast radio band, wherein the frequencies in the mobile telephony band are at least four times greater than the frequencies in the broadcast radio band.

2. An antenna assembly for a portable electronic device, the antenna assembly comprising:

an antenna having an elongated shaft that is slideable between an extended and a retracted position through an aperture defined by a housing of a portable electronic device;

a first radio lead electrically coupled to the antenna for coupling the antenna to a mobile telephony receiver at least when said antenna is in the extended position;

a second radio lead electrically coupled to the antenna for coupling the antenna to a broadcast radio receiver at least when said antenna is in the extended position; and an actuator, at least a portion of which is disposed on the elongated shaft that remains within the housing when said shaft is in each of the extended and retracted positions, the actuator for disconnecting an electrical connection between the antenna and the second radio lead when the shaft is in the retracted position.

3. The antenna assembly of claim 2 wherein the second radio lead comprises a RE choke that separates signals received at said antenna in a frequency domain.

4. The antenna assembly of claim 3 wherein the RF choke comprises a decoupling inductor.

5. The antenna assembly of claim 3 wherein the second radio lead further comprises a matching inductor in series with the RF choke, said matching inductor defining an inductance of less than about 1000 nH.

6. The antenna assembly of claim 5 wherein said antenna comprises a whip antenna, the antenna assembly further comprising a stub antenna defining an aperture through which said elongated shaft is slideable, said stub antenna coupled to the first radio lead at least when the whip antenna is in the retracted position.

7. The antenna assembly of claim 6 wherein the stub antenna is coupled to the first radio lead through the whip antenna.

8. The antenna assembly of claim 6 wherein the stub antenna and the whip antenna are coupled in parallel to the first radio lead.

9. The antenna assembly of claim 2 wherein the actuator comprises a bottom stopper disposed at an end of the elongated shaft.

10. An antenna assembly for a portable electronic device, the antenna assembly comprising:

a whip antenna having an elongated shaft that is slideable between an extended and a retracted position through an aperture defined by a housing of a portable electronic device;

a first radio lead electrically coupled to the whip antenna for coupling the whip antenna to a mobile telephony receiver at least when said whip antenna is in the extended position;

a second radio lead electrically coupled to the whip antenna for coupling the whip antenna to a broadcast radio receiver at least when said whip antenna is in the extended position; and a fixed antenna internal to said housing; wherein the first radio lead is directly coupled to the fixed antenna and is electrically coupled to the whip antenna through a non-galvanic connection between the fixed antenna and the whip antenna.

11. The antenna assembly of claim 10 wherein the non-galvanic connection comprises a parasitic coupling.

12. The antenna assembly of claim 10 wherein the whip antenna and the fixed antenna are within about 5 mm of one another at least when the whip antenna is in the extended position.

13. The antenna assembly of claim 10 wherein the second radio lead comprises a spring clip for coupling to the whip antenna, said antenna assembly further comprising an insulating barrier adjacent to said spring clip to isolate said spring clip from a common potential.

14. The antenna assembly of claim 13 wherein said second radio lead further comprises a decoupling inductor.

15. In a mobile station having a transceiver for communicating over a two-way communication system and a receiver for receiving broadcast radio signals, each within a housing of the mobile station, the improvement comprising:

an external antenna that protrudes beyond the housing and a retracted position;

a fixed antenna mounted within the housing;

a first radio lead directly coupled to the external antenna and electrically coupled to the transceiver via a parasitic connection between the fixed antenna and the external antenna; and a second radio lead coupled at one end to the receiver and at an opposed end to the external antenna.

16. In the mobile station of claim 15, the improvement further comprising:

at least one inductor disposed along the second radio lead between the external antenna and the receiver.

17. A method for receiving a signal at a mobile station comprising:

providing a mobile station having an external antenna extending outside a housing of the mobile station and a planar antenna fixed within the housing of the mobile station;

receiving a signal at the external antenna;

in the case that the signal is above a threshold frequency, providing the received signal from the external antenna to the planar antenna via a parasitic connection, and providing the signal from the planar antenna to a mobile telephony receiver via a first radio lead; and in the case that the signal is below a threshold frequency, providing the received signal from the external antenna to a broadcast radio receiver via a second radio lead.

18. The method of claim 17 further comprising:

in the case that the signal is above a threshold frequency, inhibiting the received signal from passing through the second radio lead by means of a RF choke.

19. The method of claim 18 wherein the RF choke comprises an inductor.

20. The method of claim 17, wherein the external antenna comprises an extendable whip antenna, and wherein receiving the signal comprises receiving the signal at the whip antenna while in a fully extended position.

* * * * *

UNITED STATES PATENT AND TRADEMARK OFFICE

CERTIFICATE OF CORRECTION

PATENT NO. : 7,154,442 B2
APPLICATION NO. : 10/878302
DATED : December 26, 2006
INVENTOR(S) : Jari van Wonterghem et al.

It is certified that error appears in the above-identified patent and that said Letters Patent is hereby corrected as shown below:

In Claim 1: Column 7, line 66, delete "RE" and insert --RF--.
In Claim 3: Column 8, line 24, delete "RE" and insert --RF--.
In Claim 15: Column 9, lines 16-17, delete "and a retracted position".

Signed and Sealed this

First Day of May, 2007

JON W. DUDAS
*Director of the United States Patent and Trademark Office*